United States Patent [19]

Sager

[11] Patent Number: 4,959,895

[45] Date of Patent: Oct. 2, 1990

[54] METHOD AND APPARATUS FOR SEPARATING MONOFILAMENTS FORMING A STRAND

[75] Inventor: Thomas B. Sager, Fairfield, Conn.

[73] Assignee: Branson Ultrasonics Corporation, Danbury, Conn.

[21] Appl. No.: 421,124

[22] Filed: Oct. 13, 1989

[51] Int. Cl.[5] ..... D01D 1/00; D02J 1/18

[52] U.S. Cl. ..... 28/282; 28/217; 28/219; 228/1.1

[58] Field of Search ..... 28/217, 219, 282; 228/1.1

[56] References Cited

U.S. PATENT DOCUMENTS

| | | | |
|---|---|---|---|
| 3,401,446 | 9/1968 | Obeda et al. | 29/427 |
| 3,606,114 | 10/1971 | Kim | 28/219 |
| 3,780,926 | 12/1973 | Davis | 228/1 |
| 4,249,986 | 2/1981 | Okeda | 228/1.1 |
| 4,689,244 | 8/1987 | Lusk | 427/57 |

OTHER PUBLICATIONS

"Ultrasonic Engineering", (Book), Julian R. Frederick, pp. 87–103, J. Wiley & Sons (1965).

*Primary Examiner*—Werner H. Schroeder
*Assistant Examiner*—Bibhu Mohanty
*Attorney, Agent, or Firm*—Polster, Polster and Lucchesi

[57] ABSTRACT

A method and apparatus for separating monofilaments, such as glass or carbon monofilaments, forming a strand, is achieved by feeding the strand in a curved path over and in forced contact with a plurality of rods, each being subjected to vibrations. The vibrations, applied transverse to the axis of the strand, provide intermittent localized contact between the filaments and the rod surface, hence preventing high tensile and shear forces which cause breakage of the delicate filaments. In one embodiment, the rods comprise a plurality of resonators dimensioned to be resonant along their longitudinal axis for a predetermined frequency of vibration. The resonators are energized with vibrations from a single resonator dimensioned to operate as a half wavelength resonator. The resonators are provided with a wear resistant, smooth surface coating at the area of contact with the filaments.

16 Claims, 1 Drawing Sheet

METHOD AND APPARATUS FOR SEPARATING MONOFILAMENTS FORMING A STRAND

FIELD OF THE INVENTION

This invention concerns the separation of monofilaments after extrusion, and, more specifically, refers to the separation and spreading of monofilaments, particularly glass or carbon filaments, forming after extrusion a strand, also known as tow or ribbon, for further processing, such as manufacturing fiber reinforced thermoplastics, see "Long Glass Fiber Thermoplastic Process Development—Part 1", W. J. Janosky et al, ANTEC '89, pp. 613–618 (1989).

SUMMARY OF THE INVENTION

In a typical example, a strand approximately 3 mm wide obtained from the extrusion process comprises approximately two thousand glass monofilaments, each 17 micron diameter, bonded together by sizing material. In order to separate and spread the filaments and to provide longitudinal alignment of the monofilaments for further processing, the strand, in accordance with present procedures, is drawn in a curved path over a series of highly polished stationary round metal rods. Specifically, the strand is passed over and in forced contact with a portion of the circumference of each of a plurality of rods. The curved motion of the strand and contact with the surface of the rods breaks the sizing and causes the separation and spreading of the filaments.

The present invention concerns an improvement of the above described method in that the rods are rendered vibratory along their longitudinal axis to thereby provide improved results. Using the vibration, the rate at which a strand can be drawn over the rods is increased to one hundred or more linear feet per minute and, importantly, the vibratory motion causes a significant reduction of the friction between the filaments and the rod surface thereby reducing the breakage of the delicate, individual monofilaments.

The vibrating motion causes a repetitive intermittent contact between the rods and filaments, thus preventing a sustained high tensile or shear force manifest upon the individual filaments and strand comprising the filaments.

One of the important objects of this invention, therefore, is the provision of a new and improved method for separating and spreading monofilaments comprising a strand obtained from the extrusion machinery.

Another important object of this invention is the provision of a novel method and apparatus for separating and spreading monofilaments comprising a strand by providing higher production rates and reduced filament breakage.

Another important object of this invention is the provision of one or more vibrating surfaces over which a strand, comprising several thousand monofilaments, is drawn for obtaining separation and spreading of the monofilaments.

A still other important object of this invention is the provision of an improved method and apparatus for separating and spreading monofilaments forming a strand after extrusion, using one or more elongated round metal rods vibrating axially over which the strand is drawn in a curved path.

Further and still other objects of this invention will become more clearly apparent from the following description when read in conjunction with the accompanying drawings.

DETAILED DESCRIPTION OF THE PREFERRED EMBODIMENTS

Figure 1:
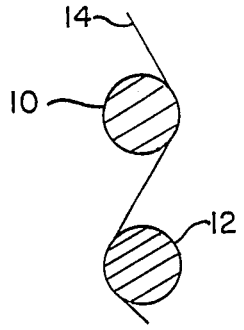
FIG.1. PRIOR ART
FIG. 1 is a schematic view showing a set of rods and a strand of monofilaments being fed over the rods per prior art.
Figure 2:
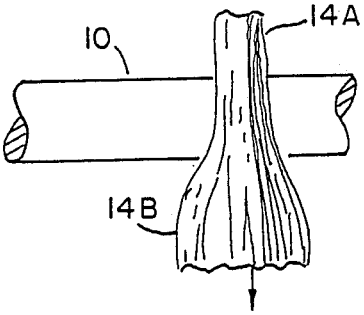
FIG.2. PRIOR ART
FIG. 2 is a schematic view illustrating the separation and spreading of the monofilaments resulting from contact with a rod.

Referring now to the figures and FIGS. 1 and 2 in particular, there is shown a pair of stationary round metal rods 10 and 12 and a strand 14 comprising several thousand glass or carbon monofilaments, each typically 17 micron diameter. The filaments are bonded together by sizing material as the strand exits the extrusion machinery. In order to separate and spread the filaments, the strand is passed in a curved path over the highly polished peripheral or side surface portion of each rod and by virtue of the disposition of the rods 10 and 12 and maintaining the strand in a taut condition, the strand and filaments therein are brought into forced contact with the respective rod surfaces. The forced tangential contact and curved path breaks the bond between the filaments caused by the sizing material. The filaments separate and spread as shown in FIG. 2 wherein numeral 14A shows the strand before reaching the rod 10 and numeral 14B illustrates the spreading. FIGS. 1 and 2 represent the prior arrangement and it will be understood that there are additional rods, not only two rods as depicted herein. The rods, of course, may be solid or tubular metal members.

Figure 3:
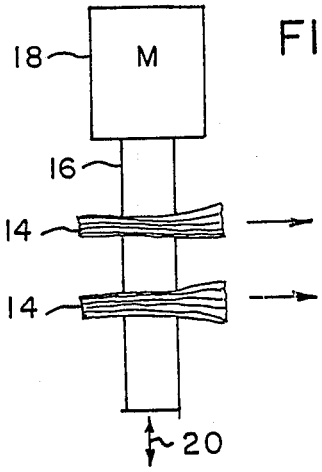
FIG. 3 is a view of a rod axially vibrated and a set of strands fed over the side of the rod.

FIG. 3 shows, schematically, the improvement provided by this invention. The round metal rod 16 is coupled to a vibrating device 18 which causes the rod 16 to vibrate axially, see arrow 20. The vibrations, assuming a magnetic device and an input frequency of 50Hz, will occur at 100Hz. Of course, the frequency may be higher as will be shown below. Two strands 14 are passed over the vibrating rod as described above. The vibrations cause the existence of intermittent contact between the filaments and a particular location of the rod surface, thus preventing the build up of a high tensile force on each filament in contact with the rod. This stress reduction causes a significant reduction of filament breakage and, therefore, permits a substantial increase of the linear feed of the strand over the rod. Again, a plurality of vibrating rods are used. As seen, the vibrations are applied substantially transverse to the longitudinal axis of the strand.

Figure 4:
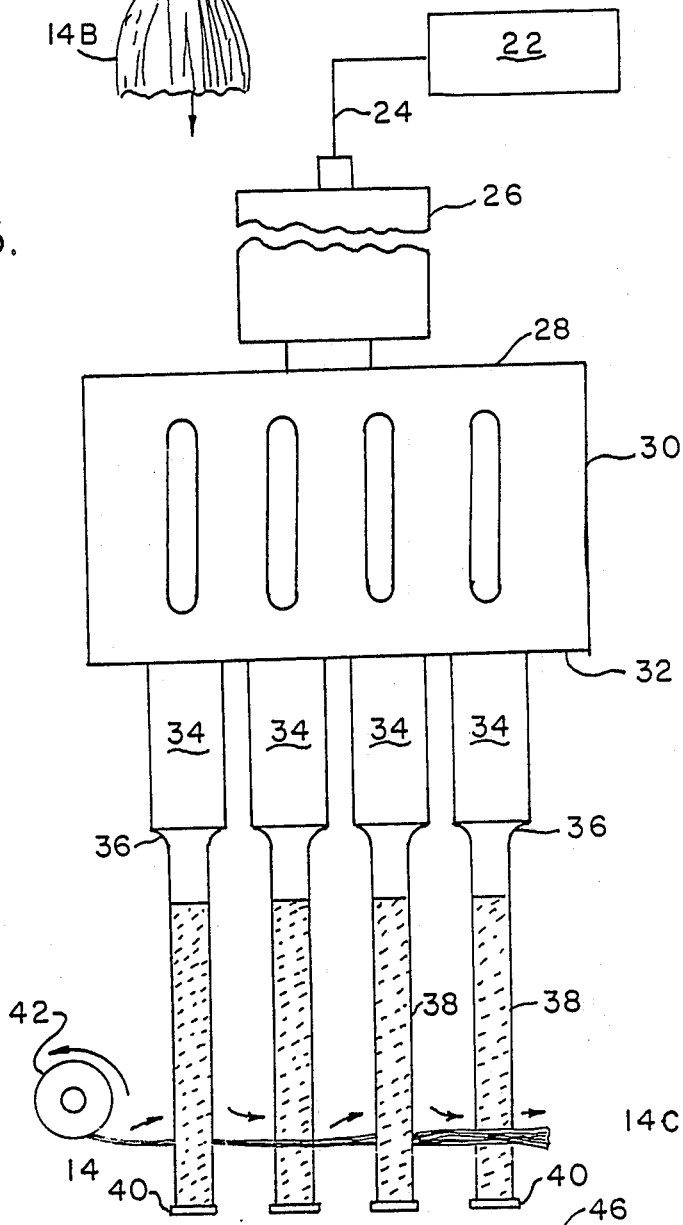
FIG. 4 is an elevational view of a high frequency apparatus for practicing the invention.
Figure 5:
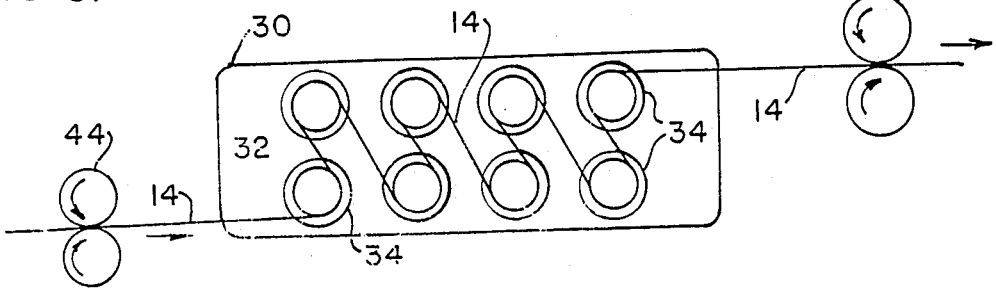
FIG. 5 is a bottom view, partially in section, of a high frequency resonator having eight rod shaped resonators extending therefrom over which a strand is fed.

A further improved method and apparatus is shown in FIGS. 4 and 5. An electrical high frequency generator 22 provides, via a cable 24, a high frequency electrical output to an electroacoustic converter 26. The converter 26 converts the applied high frequency electrical energy to mechanical vibrations utilizing, for instance, piezoelectric transducer means. The high frequency vibrations, in turn, are mechanically coupled to the input surface 28 of a solid resonator 30, also known as horn, tool, etc., see "Ultrasonic Engineering" (book) by Julian R. Frederick, pp. 87–103, John Wiley & Sons, Inc., New York, N.Y., 1965. The resonator is dimensioned to be mechanically resonant as a half wavelength resonator along its longitudinal axis between the input surface 28 and output surface 32 at a predetermined frequency of vibrations, for instance 20kHz. In the present example, the resonator or horn 30 is provided at its output surface 32 with a plurality of spaced secondary resonators or horns 34 to form a "composite horn" construction well known to those skilled in the field of ultrasonics, see U.S. Pat. No. 3,780,926 dated Dec. 25, 1973, issued to P. H. Davis, entitled "Ultrasonic Rigid Horn Assembly". As shown, the resonators 34 made of aluminum are of round shape and are dimensioned to form full wavelength resonators at the predetermined frequency of vibrations travelling longitudinally therethrough. The resonators 34 include also amplification of the mechanical amplitude of vibrations by virtue of a gain section 36 (reduction in cross-section). The lower surface portion of each resonator 34 is provided with a wear resistant smooth ceramic coating 38 (known in the trade as "Martin Hard Coating") for reducing the surface wear of the resonator caused by the abrading action of the filaments. The end surface of each resonator 34 is provided with a flared portion 40 in order to retain the filaments on the resonator. Numeral 42 denotes a reel from which a strand 14 of filaments is unwound for contact with the plurality of vibrating surfaces 34 to obtain a separation and spreading of filaments, as indicated by numeral 14C. While only one strand is shown, it will be understood that in production several strands are fed simultaneously and in parallel paths over the resonators 34 constituting the vibrating surfaces. The resonator 30, as apparent, serves as the common vibration source for the plurality of vibrating resonators 34 acting upon the strands of filaments, thus obviating the need for a separate source of vibratory energy for each rod.

With reference to FIG. 5, there is shown the output surface 32 of a resonator 30 which couples the vibrations to eight secondary resonators 34. A set of feed and tension rollers 44 feed the strand 14 along its winding and tortuous path over a portion of the surface of each resonator or rod 34 toward a set of take-up rollers 46. The rollers 44, as clearly understood, provide the appropriate tension to cause the required intimate and forced engagement between the strand 14 and the respective side surface of the resonator.

The resonators 36 are resonant along their longitudinal axis while the strand or strands are fed in the transverse direction. It is understood that the full wavelength resonators 38 exhibit along their length two nodal zones of longitudinal vibration. One zone is in the area of the cross sectional reduction 36, and the other zone is along the output portion. The feeding of the strand through the nodal region is avoided as in the nodal region substantially all vibration is in the radial direction as contrasted with the more prominent vibrations in the longitudinal direction. The latter vibrations act as a shear force upon the strand of filaments. Instead of a frequency of 20kHz, the resonators 30 and 34 can readily be dimensioned for operation, for instance, at a frequency of 10kHz, 25kHz or 50kHz without change from the basic concept revealed heretofore. A frequency of 20kHz or higher is preferred as the vibrations will be inaudible and the apparatus will be smaller in size. Moreover, the resonator 34 may be dimensioned to form half wavelength resonators when fewer strands are to be fed simultaneously.

While there has been described and illustrated a preferred embodiment of the invention and further modifications thereof have been indicated, it will be apparent to those skilled in the art that several additional changes and modifications may be made therein without deviating from the broad principle of this invention which shall be limited only by the scope of the appended claims.

I claim:

1. The method of separating and spreading monofilaments forming a strand comprising the steps of: providing a vibrating surface, and passing the strand over and in forced contact with said vibrating surface in a direction causing the vibrations to be applied to said strand substantially transverse to the longitudinal axis of said strand.

2. The method of separating and spreading monofilaments as set forth in claim 1, said monofilaments comprising glass filaments.

3. The method of separating and spreading monofilaments as set forth in claim 2, said vibrating surface being a rod vibrated axially.

4. The method of separating and spreading monofilaments as set forth in claim 2, said vibrating surface being vibrated at a frequency of at least 100Hz.

5. The method of separating and spreading monofilaments of glass forming a strand comprising the steps of: providing a plurality of vibrating rods, and passing the strand in a curved path sequentially over and in forced contact with a portion of the side of each respective rod, causing the vibrations to be applied to the strand substantially transverse to the longitudinal axis of the strand.

6. The method of separating and spreading monofilaments of glass forming a strand as set forth in claim 5, said rods comprising mechanical resonators dimensioned to be resonant along their axis at a predetermined frequency of vibration.

7. The method of separating and spreading monofilaments of glass forming a strand as set forth in claim 6, said frequency being at least 10kHz.

8. The method of separating and spreading monofilaments of glass forming a strand as set forth in claim 7, said resonators being coupled to a common source of vibrations.

9. The method of separating and spreading monofilaments of glass forming a strand as set forth in claim 8, said resonators being provided with a wear resistant surface coating at the area of contact with said strand.

10. The method of separating and spreading monofilaments of glass forming a strand as set forth in claim 6, said resonators being dimensioned to form full wavelength resonators at the predetermined frequency of vibration.

11. An apparatus for separating and spreading monofilaments forming a strand comprising:

a first resonator dimensioned to be mechanically resonant as a half wavelength resonator for vibrations of predetermined frequency travelling longitudinally therethrough from an input surface to an opposite output surface;

a plurality of elongated rod shaped second resonators coupled to said output surface for receiving said vibrations from said first resonator, each of said second resonators dimensioned to be mechanically resonant for vibrations at said frequency travelling longitudinally therethrough, and feed means disposed for feeding the strand along a curved path over and in forced contact with the side surface of each respective second resonator for causing said vibrations to be applied to said strand substantially transverse to the longitudinal axis of the strand.

12. An apparatus for separating and spreading monofilaments forming a strand as set forth in claim 11, said first and said second resonators dimensioned to be resonant at a frequency of at least 10kHz.

13. An apparatus for separating and spreading monofilaments forming a strand as set forth in claim 12, said second resonators comprising round metal rods, each dimensioned to operate as a full wavelength resonator at said predetermined frequency.

14. An apparatus for separating and spreading monofilaments forming a strand as set forth in claim 13, each of said second resonators including a mechanical gain portion for increasing the amplitude of vibration and including a wear resistant surface coating at the area of contact with said strand.

15. An apparatus for separating and spreading monofilaments forming a strand as set forth in claim 14, each of said second resonators having a flared end surface for retaining the strand on the surface of the respective resonator.

16. An apparatus for separating and spreading monofilaments forming a strand as set forth in claim 11, and an electrical high frequency generator and an electracoustic converter coupled to said first resonator for causing said first resonator and said second resonators to be rendered resonant.

* * * * *